United States Patent [19]

Knox, Sr.

[11] 4,011,850

[45] Mar. 15, 1977

[54] FUEL VAPORIZER FOR INTERNAL COMBUSTION ENGINES

[76] Inventor: Kenneth L. Knox, Sr., 1796 Hillboro Ave., Reno, Nev. 89502

[22] Filed: July 30, 1975

[21] Appl. No.: 600,320

[52] U.S. Cl. ..... 123/141; 261/79 R; 48/180 S

[51] Int. Cl.[2] ..... F02M 29/00

[58] Field of Search ..... 123/141, 119 E; 261/78 R, 79 R; 48/180 R, 180 S

[56] References Cited

UNITED STATES PATENTS

| | | | |
|---|---|---|---|
| 623,567 | 4/1899 | Secor | 123/141 |
| 1,051,369 | 1/1913 | Heath | 123/141 |
| 1,106,452 | 8/1914 | Ihner | 123/141 |
| 2,093,918 | 9/1937 | Lord | 123/141 |
| 2,152,206 | 3/1939 | Neal | 123/141 |
| 2,273,957 | 2/1942 | Harrell | 123/141 X |
| 2,659,667 | 11/1953 | Bosdet | 123/141 X |
| 2,969,782 | 1/1961 | Falzone | 123/141 X |
| 3,164,451 | 1/1965 | Almquist | 123/141 X |
| 3,544,290 | 12/1970 | Larson et al. | 123/141 X |
| 3,615,296 | 10/1971 | Guarnaschelli | 123/141 X |

*Primary Examiner*—C. J. Husar
*Assistant Examiner*—Ira S. Lazarus
*Attorney, Agent, or Firm*—Blair & Brown

[57] ABSTRACT

A fuel vaporizer for internal combustion engines interposed between the intake manifold and the carburetor. The intake manifold is formed as a part of the fuel vaporizer and has all of the pipes extending to the separate cylinders formed of the same length and diameter or proportionate lengths and diameters such that fuel will be delivered equally to each cylinder. The vaporizer includes an impeller fan blade which is driven at high speed by the flow of air thereover with the impeller vaporizing the gasoline in the gasoline air mixture passing thereover.

1 Claim, 2 Drawing Figures

FUEL VAPORIZER FOR INTERNAL COMBUSTION ENGINES

BACKGROUND OF THE INVENTION

Field of the Invention

The present invention relates to fuel vaporizers for vaporizing fuel in the fuel air mixture between the carburetor and intake manifold of an internal combustion engine.

SUMMARY OF THE INVENTION

A fuel vaporizer for an internal combustion engine is formed as part of the intake manifold with the pipes of the intake manifold having equal length and diameter or proportionate length and diameter so that equal quantities of fuel are delivered to each cylinder of the engine. The vaporizer is positioned in a housing connected to the pipes and includes an impeller fan driven by the fuel air mixture flowing thereover. A deflector is arranged above the fan so that air meets the fan in a manner to cause the fan to spin at very high RPM's to best vaporize the gasoline passing thereover.

A conventional carburetor is secured to the upper portion of the vaporizer to provide fuel thereto.

The primary object of the invention is to provide a gasoline vaporizer attachment for internal combustion engines which will increase the economy, horsepower and performance of the engine.

Other objects and advantages will become apparent in the following specification when considered in light of the attached drawings.

DESCRIPTION OF THE PREFERRED EMBODIMENT

Figures 1, 2:
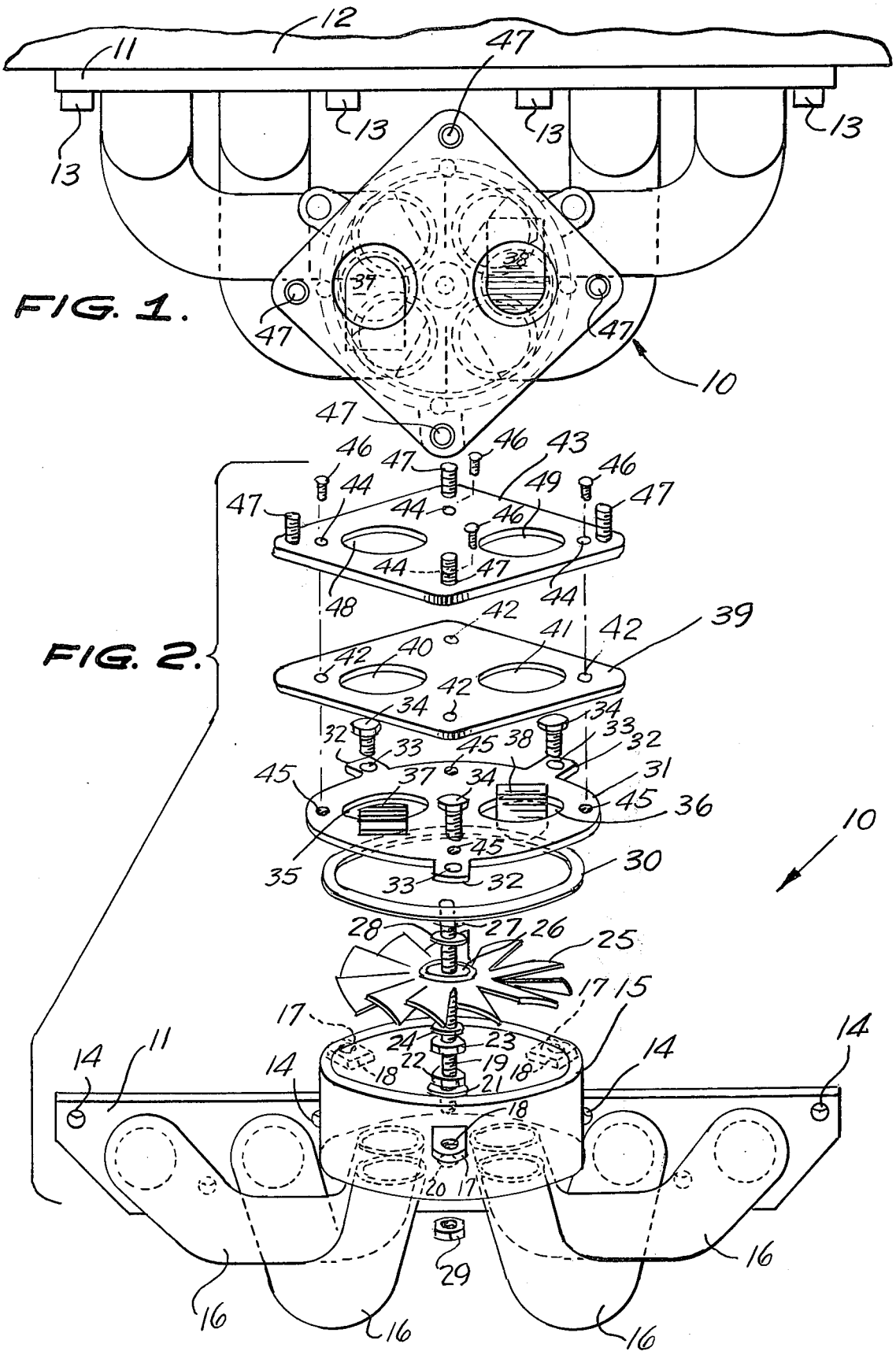
FIG. 1 is a top plan view of the invention.
FIG. 2 is an exploded perspective view of the invention.

Referring now to the drawings in detail wherein like reference characters indicate like parts throughout the several Figures, the reference numeral 10 indicates generally a fuel vaporizer for internal combustion engines constructed in accordance with the invention.

The fuel vaporizer 10 includes a generally flat plate 11 which is adapted to be secured to an internal combustion engine shown fragmentarily at 12 by means of a plurality of cap screws 13. The cap screws 13 extend through bores 14 in the plate 11 as can be seen in FIGS. 1 and 2.

A generally cylindrical housing 15 is secured to a plurality of intake pipes 16 which extend into the bottom of the housing 15 and are secured thereto. The pipe 16 are in turn connected to the plate 11 and communicate therethrough so as to provide fuel to the intake passages of the engine 12. Each of the intake pipes 16 are of equal length and diameter or have their lengths and diameters proportionate so as to feed equal quantities of fuel from the housing 15 to the plate 11.

A plurality of ears 17 are secured to the outer face of the housing 15 and have bores 18 extending therethrough for reasons to be assigned. A threaded shaft 19 is threaded into the axial bore 20 in the bottom of the housing 15. A washer 21 is positioned on the threaded shaft 19 against the bottom of the housing 15 and is locked in place by a lock nut 22.

A nut 23 is positioned on the shaft 19 above the nut 22 and a washer 24 is positioned thereagainst. A multi-bladed fan 25 is journalled on a bearing 26 on the shaft 19 and is secured in place thereon by means of the nut 23 and washer 24 and a nut 27 engaging against a washer 28.

The shaft 19 has a length slightly greater than the height of the housing 15 and a nut 29 locks the lower end of the shaft 19 to the housing 15.

A gasket 30 is positioned against the top edge of the housing 15 and a housing cover plate 31 of generally cylindrical form engages thereagainst. The plate 31 has a plurality of ears 32 extending outwardly therefrom and arranged in aligned relation with the ears 17 on the housing 15. Each of the ears 32 has a bore 33 extending therethrough and a cap screw 34 extends through the bore 33 and is threaded into the bore 18 of the ears 17. A pair of oppositely disposed apertures 35–36 are arranged in the plate 31 with a downwardly sloping air deflector guide 37–38 extending into the apertures 35–36 respectively to deflect the air oppositely in order to drive the impeller blade 25 at a relatively high speed.

A gasket 39 is positioned against the plate 31 and has apertures 40–41 extending therethrough. The gasket 39 has a plurality of bores 42 extending therethrough for reasons to be assigned.

A carburetor base plate 43 is positioned against the gasket 39 and has a plurality of bores 44 extending downwardly therethrough in aligned relation to the bores 42 in the gasket 39. A plurality of threaded bores 45 extend through the plate 31 in aligned relation to the bores 42 in the gasket 39 and the bores 44 in the carburetor base plate 43. A plurality of cap screws 46 extend through the bores 44 and the bores 42 and are threaded into the bores 45 in order to lock the base plate to the cover plate 31 with the gasket 39 therebetween.

A plurality of threaded studs 47 are rigidly secured to the carburetor base plate 43 and extend upwardly therefrom to receive the base of a carburetor (not shown) which is adapted to be secured thereto. The carburetor base plate 43 has a pair of oppositely disposed apertures 48–49 coinciding with the apertures 40–41 in the gasket 39 and the apertures 35–36 in the plate 31. The apertures 48–49 are adapted to coincide with similar apertures in the base of the carburetor (not shown) so that fuel and air mixed in the carburetor can pass into the housing 15 after being deflected by the air deflectors 37–38 so as to cause the impeller 25 to spin at high speeds and thus vaporize the gasoline contained in the fuel air mixture reaching the housing 15.

The use of pipes 16 of equal length and diameter or of proportionate length and diameter permits the fuel from the housing 15 to be distributed equally to each of the cylinders in a conventional internal combustion engine.

Having thus described the preferred embodiment of the invention it should be understood that numerous structural modifications and adaptations may be resorted to without departing from the spirit of the invention.

What is claimed is:

1. In combination with an internal combustion engine a fuel vaporizer comprising an intake manifold plate adapted to be connected to the engine, a plurality of pipes communicating with said engine through said plate and rigidly connected to said plate said pipes having substantially equal lengths and diameters, a generally cylindrical housing rigidly secured to the opposite end of said pipes and communicating therewith, an impeller blade in said housing rotated at high speed by air and fuel passing through said housing for vaporizing the fuel, means providing a mounting for a carburetor including a flat plate positioned closely adjacent said impeller blade and having a pair of relatively large bores equispaced on opposite sides of the axis of said impeller blade and communicating with the carburetor, and air deflection means including a pair of elements carried by said flat plate and extending respectively transversely of said bores with said elements sloping oppositely of each other and toward said impeller for causing the flow of air to impinge on the impeller blade in a direction to drive the impeller blade at high speed.

* * * * *